US010464117B2

(12) United States Patent
Kim

(10) Patent No.: US 10,464,117 B2
(45) Date of Patent: Nov. 5, 2019

(54) PROGRESSIVE DIE MACHINE AND PROGRESSIVE FORMING METHOD

(71) Applicant: HYUNDAI MOTOR COMPANY, Seoul (KR)

(72) Inventor: Young Tae Kim, Gunpo-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 340 days.

(21) Appl. No.: 15/141,254

(22) Filed: Apr. 28, 2016

(65) Prior Publication Data

US 2016/0339499 A1 Nov. 24, 2016

(30) Foreign Application Priority Data

May 20, 2015 (KR) ..... 10-2015-0070322

(51) Int. Cl.
*B21D 37/08* (2006.01)
*B21D 24/00* (2006.01)
*B21D 22/02* (2006.01)

(52) U.S. Cl.
CPC ..... *B21D 24/005* (2013.01); *B21D 22/022* (2013.01); *B21D 37/08* (2013.01)

(58) Field of Classification Search
CPC .... B21D 22/208; B21D 24/005; B21D 37/08; B21D 37/16; B21D 43/02; B21D 22/022; B21D 22/20
See application file for complete search history.

(56) References Cited

U.S. PATENT DOCUMENTS 2,165,105 A * 7/1939 Krejci ..... H01K 3/04 266/128
2,371,459 A * 3/1945 Mittelmann ..... H05B 6/40 148/573
3,184,796 A * 5/1965 Southcott ..... B29B 13/024 425/384
3,193,881 A * 7/1965 Kostur ..... B29C 51/18 226/173

(Continued)

FOREIGN PATENT DOCUMENTS

CN 1611310 A 5/2005
CN 104099457 A 10/2014

(Continued)

OTHER PUBLICATIONS

Translation, JP 2005-131665A, May 2005.*
China Office Action dated Nov. 22, 2018 from the corresponding Chinese Application No. 201610181800.7), 18 pp.

*Primary Examiner* — Edward T Tolan
(74) *Attorney, Agent, or Firm* — Brinks Gilson & Lione

(57) ABSTRACT

A progressive die machine improves forming quality of a low formability material such as an ultra-high strength steel material, or the like, and enhances productivity by adopting rapid heating to a progressive method. The progressive die machine includes: a lower die; an upper die installed to vertically reciprocate with respect to the lower die; a material transfer unit to sequentially transfer a material in a length direction between the upper die and a lower die; a plurality of forming stations installed in the upper die and the lower die; and a rapid heating station installed to be adjacent to at least one of the plurality of forming stations.

9 Claims, 7 Drawing Sheets

(56) References Cited

U.S. PATENT DOCUMENTS

| | | | | | |
|---|---|---|---|---|---|
| 4,382,374 | A * | 5/1983 | Kopineck | B21B 45/008 | 72/202 |
| 5,842,267 | A * | 12/1998 | Biederman | B21J 5/12 | 72/185 |
| 6,003,359 | A * | 12/1999 | Futamura | B21D 22/208 | 72/342.1 |
| 6,772,617 | B1 * | 8/2004 | Allen | B21D 1/00 | 72/302 |
| 9,206,488 | B2 * | 12/2015 | Ishiguro | B21D 22/022 | |
| 2002/0043091 | A1 * | 4/2002 | Quick | B21C 1/003 | 72/342.1 |
| 2003/0056562 | A1 * | 3/2003 | Kamano | B21J 1/006 | 72/342.7 |
| 2007/0039366 | A1 * | 2/2007 | Michel | B21D 22/185 | 72/38 |
| 2014/0294369 | A1 | 10/2014 | Yang et al. | | |
| 2018/0050378 | A1 * | 2/2018 | Martin Gonzalez | B21D 22/022 | |

FOREIGN PATENT DOCUMENTS

| | | | | |
|---|---|---|---|---|
| JP | H05-138663 | | 6/1993 | |
| JP | 2005-131665 | A * | 5/2005 | B21D 22/20 |
| JP | 2006-142368 | | 6/2006 | |
| JP | 2011-230788 | | 11/2011 | |
| KR | 10-1992-0000399 | | 1/1992 | |
| KR | 10-1163153 | | 7/2012 | |
| KR | 10-2013-0075852 | | 7/2013 | |
| KR | 10-2013-0110859 | | 10/2013 | |
| KR | 10-1359055 | | 2/2014 | |
| KR | 10-2014-0071803 | | 6/2014 | |
| WO | 2014/051014 | A1 | 4/2014 | |

* cited by examiner

PROGRESSIVE DIE MACHINE AND PROGRESSIVE FORMING METHOD

CROSS-REFERENCE TO RELATED APPLICATION

This application claims the benefit of and priority to Korean Patent Application No. 10-2015-0070322, filed on May 20, 2015, which is incorporated herein by reference in its entirety.

FIELD

The present disclosure relates to a progressive die machine, and more particularly, to a progressive die machine for securing forming quality.

BACKGROUND

The statements in this section merely provide background information related to the present disclosure and may not constitute prior art.

In order to enhance fuel efficiency of automobiles, car bodies and chassis are desired to be reduced in weight, and the most effective method for reducing a weight includes a scheme of using a material having a low specific gravity or a scheme of reducing a thickness of a material compared with an existing material.

However, the scheme of using a material having a low specific gravity has shortcomings in that cost is significantly increased, and the scheme of reducing a thickness of a material compared with an existing material is easy to secure strength through application of an ultra-high strength steel material but involves weak rigidity.

In the scheme of reducing a thickness of a material, rigidity may be reinforced by changing a design structure of a product. In this case, however, a shape of a product may be complicated and, in particular, application of an ultra-high strength steel material has limitations in processing a product having a complicated shape due to low formability of the ultra-high strength steel.

Any one of a general die and a progressive die is selectively used in a forming method using the ultra-high strength steel material.

The forming method using the general die is disadvantageous in that it has low productivity as each unit process using several dies is individually performed.

In contrast, we have discovered that in the forming method using the progressive die, a plurality of unit processes (forming, bending, shearing, and piercing, etc.) may be continuously performed through sequential transfer in a single die, obtaining high productivity and being appropriate for mass-production to reduce cost.

However, the progressive die has limitations in forming a product having a complicated shape, and in particular, when a material having low formability such as an ultra-high strength steel material is applied to the progressive method, cracks may easily occur due to low formability of the material and machining accuracy and forming quality are significantly degraded.

SUMMARY

An aspect of the present disclosure provides a progressive die machine for improving forming quality and machining accuracy of a low formability material such as an ultra-high strength steel material, or the like, and significantly enhancing productivity by adopting rapid heating to a progressive method, and a progressive forming method thereof.

According to one form of the present disclosure, a progressive die machine for continuously forming a material, while sequentially transferring the material, includes: a lower die; an upper die installed to vertically reciprocate with respect to the lower die; a material transfer unit configured to sequentially transfer a material in a length direction between the upper die and the lower die; a plurality of forming stations installed in the upper die and the lower die; and a rapid heating station installed to be adjacent to at least one of the plurality of forming stations.

The progressive die machine may further include: a pre-forming station installed to be adjacent to an entrance of the upper die and the lower die, wherein the rapid heating station may be disposed on a downstream side of the pre-forming station.

The rapid heating station may be disposed to be adjacent to an upstream side of at least one of the plurality of forming stations.

The rapid heating station may include: a heat source disposed to be spaced apart from the sequentially transferred material; and a reflector configured to reflect heat generated by the heat source toward the material.

The heat source may be a near infrared ray lamp, and the reflector may have a curved surface.

The heat source may be a laser source, and the reflector may have a curved surface.

An optical member configured to distribute heat from the laser source may be disposed between the laser source and the sequentially transferred material.

The heat source may be an inductive heating coil, and the reflector may have a curved surface.

A thermally conductive heating body may be disposed between the inductive heating coil and the sequentially transferred material, and the thermally conductive heating body may be installed to be in contact with the material or to be spaced apart from the material.

The reflector may have a parabolic curved surface.

The reflector may have an open oval curved surface.

The rapid heating station may include a first heater installed on the upper die side and a second heater installed on the lower die side.

The rapid heating station may be installed to be inserted into at least any one of the upper die and the lower die, and rapidly heat the sequentially transferred material cooperatively according to an operation of the upper die and the lower die.

According to another exemplary form of the present disclosure, a progressive forming method for continuously forming a material, while sequentially transferring the material, includes: a material transfer operation of continuously transferring the material in a length direction between an upper die and a lower die; a pre-processing operation of continuously pre-forming the material transferred from the material transfer operation; a rapid heating operation of continuously rapidly heating the material pre-formed through the pre-processing operation; and a forming operation of causing the material rapidly heated through the rapid heating operation to sequentially pass through the plurality of forming stations and continuously performing a plurality of individual formings on the material.

In the rapid heating operation, a predetermined region of the material may be rapidly heated from a point in time at which the pre-processing operation is terminated to a point in time at which the forming operation starts to be performed.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
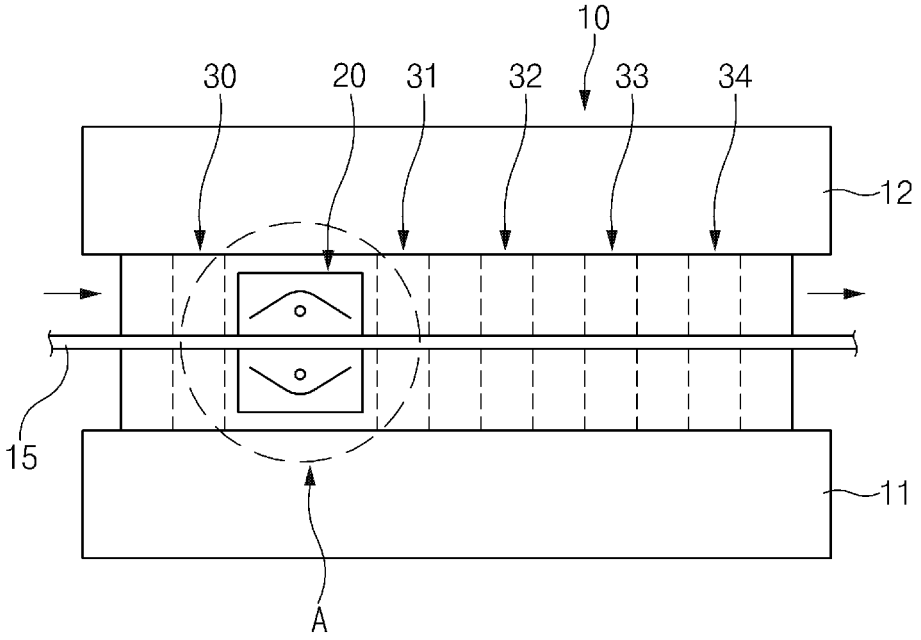
FIG. 1 is a view illustrating a configuration of a progressive die machine.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

For reference, dimensions of elements or thicknesses of lines illustrated in the drawings referred to describe the present disclosure may be exaggerated for the convenience of understanding. Also, the terms used henceforth have been defined in consideration of the functions of the present disclosure, and may be altered according to the intent of a user or operator, or conventional practice. Therefore, the terms should be defined on the basis of the entire content of this specification.

FIG. 1 is a view illustrating a configuration of a progressive die machine according to an exemplary form of the present disclosure.

Referring to FIG. 1, the progressive die machine includes: a lower die 11 fixed to a floor surface, an upper die 12 installed to vertically reciprocate with respect to the lower die 11, a material transfer unit (not shown) sequentially transferring a material 15 in a length direction between the upper die 12 and the lower die 11, a plurality of forming stations 31, 32, 33, and 34 installed in the upper die 12 and the lower die 11, and a rapid heating station 20 installed to be adjacent to at least one of the plurality of forming stations 31, 32, 33, and 34.

The lower die 11 is fixed to the floor surface and extends in a length direction.

The upper die 12 is installed to vertically reciprocate with respect to the lower die 11 from an upper side of the lower die 11.

The material transfer unit (not shown) may be configured to sequentially transfer the material 15 according to a forming process of each of the forming stations 31, 32, 33, and 34 between the upper die 12 and the lower die 11. In particular, the material transfer unit (not shown) sequentially transfers the material 15, which has been introduced to an entrance of the upper die 12 and the lower die 11, according to the forming process of each of the forming stations 31, 32, 33, and 34.

Each of the plurality of forming stations 31, 32, 33, and 34 is configured to perform various individual forming such as bending, drawing, piercing, and trimming according to demand specification of a product. Each of the forming stations 31, 32, 33, and 34 has various forming tools corresponding to desired individual forming, and each of the forming tools is installed in positions of the upper die 12 and the lower die 11 corresponding to each other. The plurality of forming stations 31, 32, 33, and 34 may perform individual forming on a material sequentially transferred as the upper die 12 periodically vertically reciprocates with respect to the lower die 11.

The aforementioned lower die 11, the upper die 12, the material transfer unit (not shown), the plurality of forming stations 31, 32, 33, and 34 are similar to a configuration of a general progressive die machine, and thus, a detailed description thereof will be omitted.

The rapid heating station 20 is installed to be adjacent to at least one of the plurality of forming stations 31, 32, 33, and 34.

A sequentially transferred material may be rapidly heated by the rapid heating station 20, whereby the forming process desiring high formability may be effectively performed to significantly enhance forming quality and machining accuracy, and in particular, since a material sequentially transferred by the rapid heating station 20 is sequentially rapidly heated, formability of a low formability material such as an ultra-high strength steel, or the like, may be significantly enhanced to enhance the forming limitation of the low formability material.

In particular, the rapid heating station 20 may be disposed to be adjacent to an upstream side of a forming station performing a forming process desiring high formability such as deep drawing, high precision bending with a small bending radius.

As the rapid heating station 20 rapidly heats a low formability material such as ultra-high strength steel, or the like, activation, recrystallization, or phase transformation of lattice vibrational energy may be induced in the low formability material by thermal energy to significantly enhance formability thereof. Also, since the low formability material may be easily applied within a cycle time of the progressive method, high productivity unique thereto may be effectively implemented.

A pre-forming station 30 is installed to be adjacent to the entrance of the upper die 12 and the lower die 11. For example, the pre-forming station 30 is installed in the upmost stream of a material transfer direction. Due to the pre-forming station 30, pre-forming such as blanking or rough bending may be effectively performed before individual forming of a material is performed by the plurality of forming stations 31, 32, 33, and 34.

In the present disclosure, the rapid heating station 20 may be disposed in a downstream side of the pre-forming station 30, and thus, the rapid heating station 20 may pass through after pre-forming is performed by the pre-forming station 30, whereby a waste of thermal energy used for heating the material 15 may be inhibited or prevented and forming quality of the material 15 and productivity may be further increased.

In particular, the rapid heating station 20 is disposed to be adjacent to the upstream side of at least one of the plurality of forming stations 31, 32, 33, and 34. Thus, by disposing the rapid heating station 20 to be adjacent to the upstream side of the forming station desiring high formability such as deep drawing or precise bending with a small bending radius among the plurality of forming stations 31, 32, 33, and 34, forming with high precision such as deep drawing or bending may be easily performed, and since the rapid heating station is not disposed in a forming station not requiring relatively high formability, manufacturing cost and thermal energy may be reduced.

As illustrated in FIGS. 2 to 4B, the rapid heating station 20 includes a heat source 23*a*, 23*b*, or 23*c* disposed to be spaced apart from a sequentially transferred material and a reflector 24 reflecting heat generated by the heat source 23*a*, 23*b*, or 23*c* toward the material 15.

In this manner, since the structure in which heat generated by the heat source 23*a*, 23*b*, or 23*c* spaced apart from the material 15 by a predetermined interval is reflected by the reflector 24 toward the material 15 is provided, rapid heating may be effectively performed on the material 15.

As the heat source 23*a*, 23*b*, or 23*c*, various types of heat source that may be able to obtain an appropriate heating temperature according to types of the material 15 may be selectively employed, and in particular, an appropriate heat source having a heating rate in parallel with a transfer rate of the material may be applied.

Figure 2:
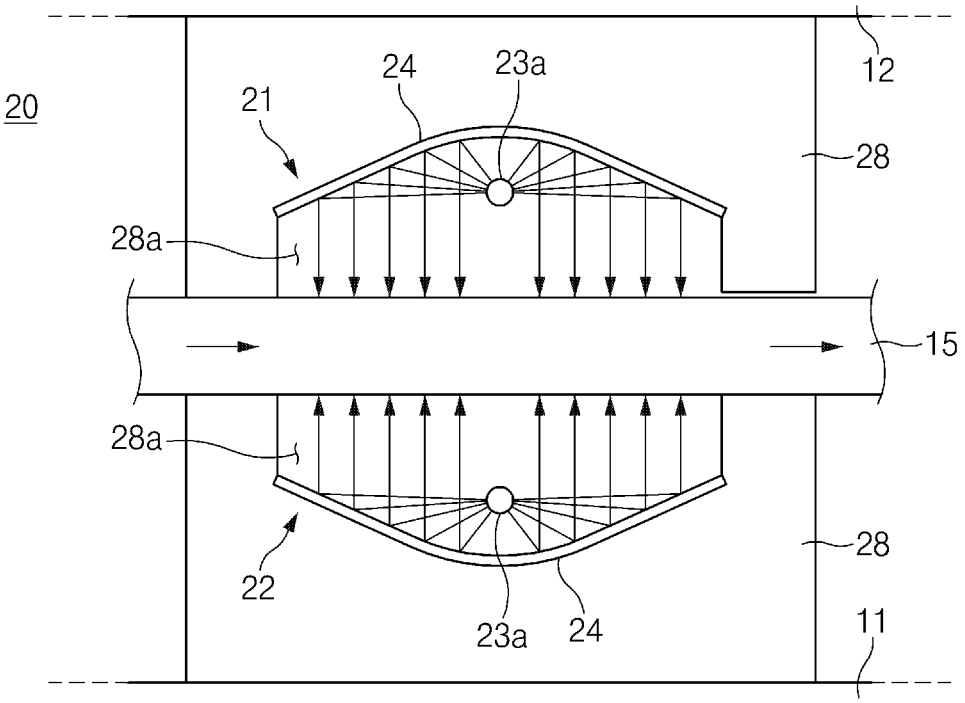
FIG. 2 is an enlarged view of a portion "A" indicated by the arrow of FIG. 1, illustrating one form of a rapid heating station.

According to the exemplary form of FIG. 2, the heat source of the rapid heating station 20 may be formed as a near infrared ray lamp 23*a*, and the reflector 24 may have a curved surface.

Figure 3:
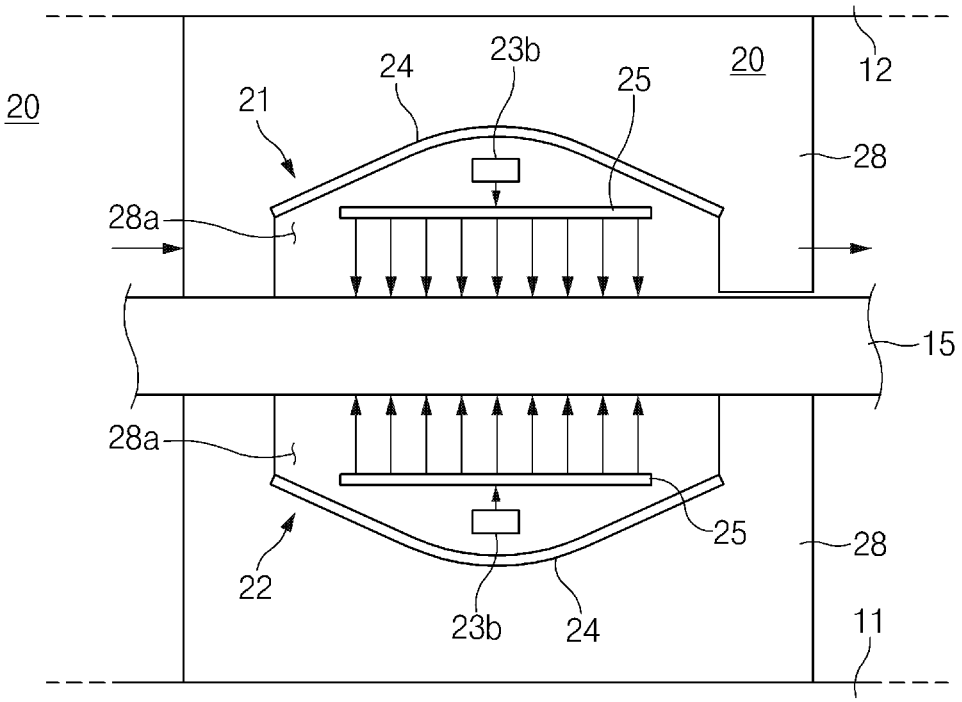
FIG. 3 is a view illustrating another form of FIG. 2.

According to the exemplary form of FIG. 3, the heat source of the rapid heating station 20 is a laser source 23*b*, and the reflector 24 may have a curved surface. An optical member 25 uniformly distributing heat from the laser source 23*b* toward the material 15 is disposed between the laser source 23*b* and the sequentially transferred material 15. The optical member 25 may irradiate various beams from the laser source 23*b* according to a structure thereof.

As illustrated in FIGS. 2 and 3, the rapid heating station 20 is installed in the upper die 12 and/or the lower die 11 through a rapid heating mold 28. In particular, the rapid heating mold 28 has an accommodation space 28*a* opened toward the material 15, and the heat source 23*a* or 23*b*, the reflector 24, and the optical member 25 of the rapid heating station 20 are accommodated in the accommodation space 28*a* of the rapid heating mold 28, whereby the rapid heating station 20 is inserted into the upper die 12 and/or the lower die 11.

As the rapid heating station 20 is installed in the upper die 12 and/or the lower die 11 by the medium of the rapid heating mold 28, the rapid heating station 20 may effectively perform rapid heating on the material 11 by interworking with the upper die 12 and the lower die 11. In detail, the rapid heating station 20 may effectively perform rapid heating on the material 11 as the upper die 12 relatively vertically reciprocates with respect to the lower die 11.

Figure 4A:
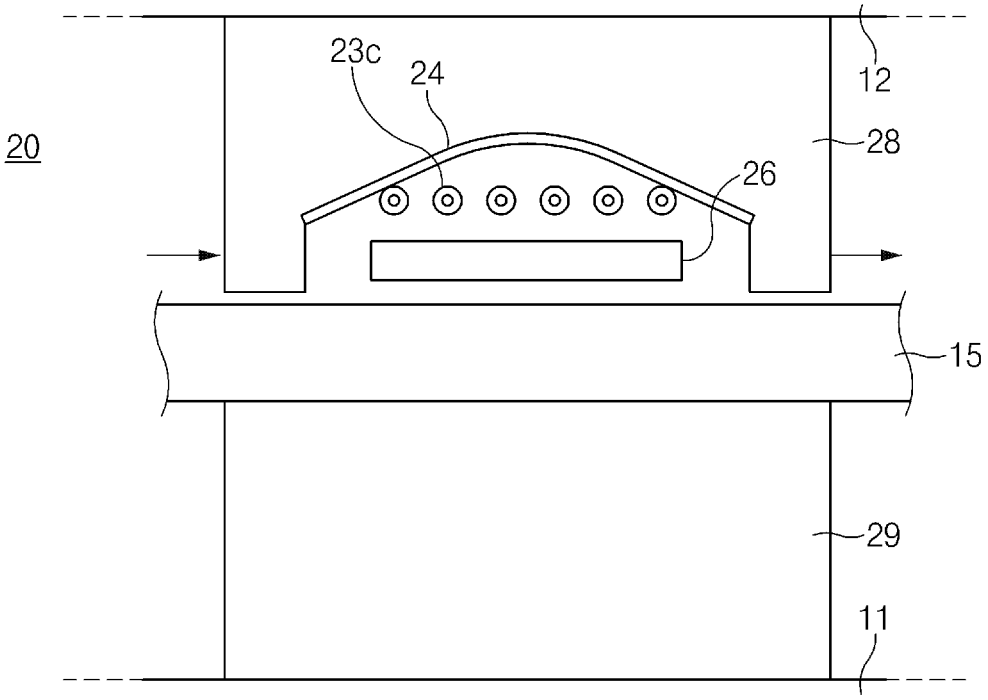
FIG. 4A and FIG. 4B are a view illustrating another exemplary form of FIG. 2.
Figure 4B:
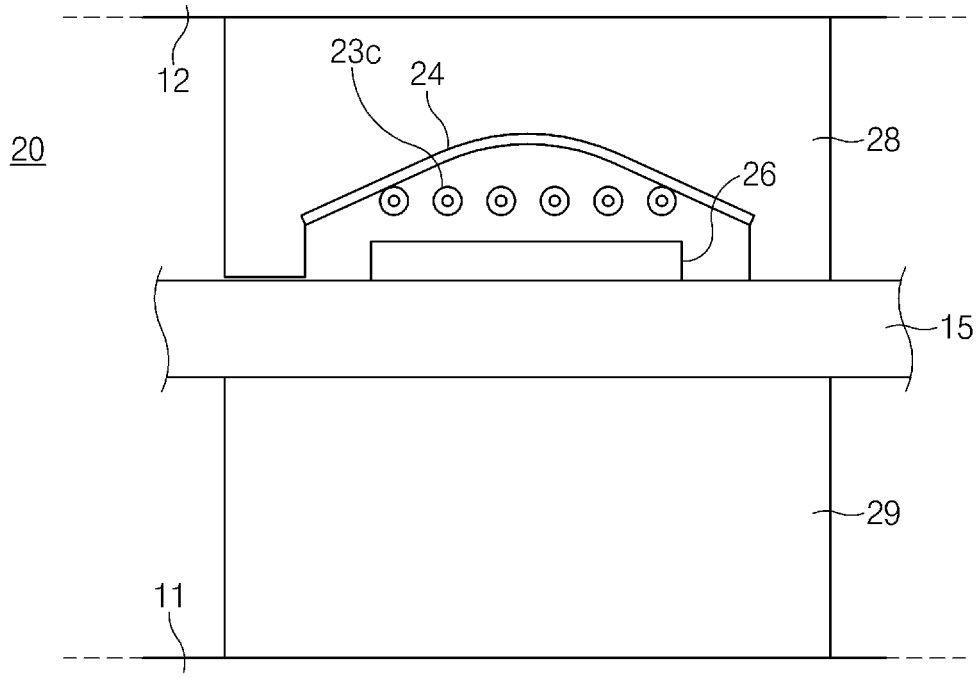

According to the exemplary form of FIGS. 4A and 4B, the heat source of the rapid heating station 20 may be formed as an inductive heating body 23*c*, and the reflector 24 has a curved surface.

A thermally conductive heating body 26 is disposed between the inductive heating body 23*c* and the sequentially transferred material 15. As illustrated in FIGS. 4A and 4B, the thermally conductive heating body 26 is installed to be spaced apart from the material 15 or may be in contact with the material 15. In detail, in a state in which the thermally conductive heating body 26 is spaced apart from the material 15 as illustrated in FIG. 4A, after heat from the inductive heating body 23*c* is sufficiently transferred to the thermally conductive heating body 26 through the reflector 24, or the like, the thermally conductive heating body 26 may be brought into direct contact with the material 15 to directly transfer the corresponding heat to the material 15 as illustrated in FIG. 4B. Also, as the thermally conductive heating body 26 is in direct contact with the material 15, a shape of a contact surface thereof may be variously formed according to a forming structure, and here, advantageously, a heating type of the material 15 may be freely obtained according to a shape of the contact surface of the thermally conductive heating body 26. Here, since inductive heating may cause large temperature variations, in one form, the thermally conductive heating body 26 has high thermal conductivity.

As illustrated in FIGS. 4A and 4B, the rapid heating station 20 is installed in the upper die 12 through the rapid heating mold 28, and a support mold 29 guiding or supporting the sequentially transferred material 15 is installed on one side of the lower die 11 corresponding to the rapid heating station 20. In particular, the rapid heating mold 28 has the accommodation space 28*a* opened toward the material 15, and the inductive hating body 23*c*, the reflector 24, and the thermally conductive heating body 26 of the rapid heating station 20 are accommodated in the accommodation space 28*a* of the rapid heating mold 28, whereby the rapid heating station 20 is inserted into the upper die 12.

In this manner, since the rapid heating station 20 is installed in the upper die 12 by the medium of the rapid heating mold 28, the rapid heating station 20 may effectively perform rapid heating on the material 15 as the upper die 12 relatively vertically reciprocates with respect to the lower die 11.

A heating area of the material 15 may be variously adjusted by a structure of the reflector 24.

Figure 5A:
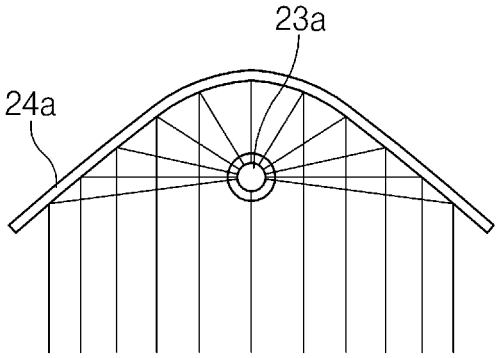
FIG. 5A and FIG. 5B are a view illustrating an exemplary form of a reflector of a progressive die machine.
Figure 5B:
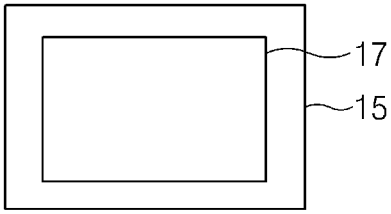

According to an exemplary form, a reflector 24*a* may have a parabolic curved surface as illustrated in FIG. 5A, thus obtaining a large heating area 17 on a surface of the material 15 as illustrated in FIG. 5B. By applying the reflector 24*a* having the parabolic curved surface to a forming process desiring a large heating area such as drawing, or the like, heating of a larger area may be facilitated, while reducing heat loss.

Figure 6A:
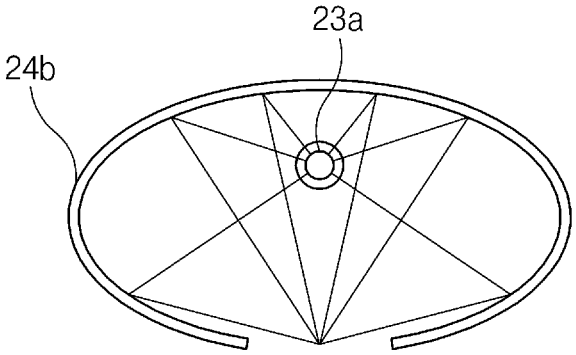
FIG. 6A and FIG. 6B are a view illustrating another exemplary form of a reflector of a progressive die machine.
Figure 6B:
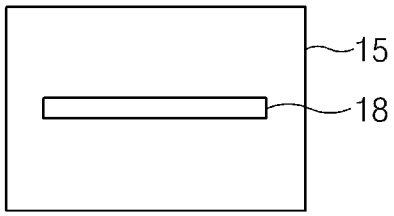

According to another exemplary form, a reflector 24*b* may have an open oval curved surface as illustrated in FIG. 6A, thus obtaining a relatively narrow heating area 18 on a surface of the material 15 as illustrated in FIG. 6B. By applying the reflector 24*b* having the open oval curved surface to a forming process desiring a narrow linear heating area such as bending, or the like, a narrow heating area and a high heating rate may be effectively obtained.

As illustrated in FIGS. 2 and 3, the rapid heating station 20 includes a first heater 21 installed on the upper die 12 side and a second heater 22 installed on the lower die 11 side. The first and second heaters each include the heat source 23*a*, 23*b*, or 23*c*, and the reflector 24.

In this manner, since the first and second heaters 21 and 22 are respectively provided in the upper die 12 and the lower die 11, upper and lower surfaces of the material 15 may be uniformly stabilized, whereby the material 15 may be rapidly heated effectively.

On a downstream side (in the transfer direction of the material 15) of the rapid heating station 20, a separate coolant line (not shown) may be installed within the upper die 12 and/or the lower die 11, and thus, structural transformation after heating the material 15, or the like, may be effectively induced through cooling control.

Figure 7:
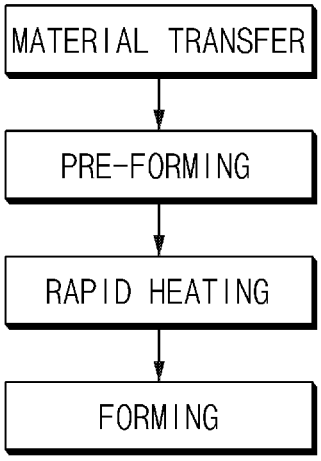
FIG. 7 is a view illustrating a sequential process of a progressive forming method.

FIG. 7 is a view illustrating a sequential process of a progressive forming method according to an exemplary form of the present disclosure.

The progressive forming method according to an exemplary form of the present disclosure includes a material transfer operation (S1) of continuously transferring a material 15 in a length direction between an upper die 12 and a lower die 11, a pre-processing operation (S2) of continuously pre-forming the material 15 transferred in the material transfer operation by a pre-forming station 30, a rapid heating operation (S3) of continuously rapidly heating the material pre-formed through the pre-processing operation by the rapid heating station 20, and a forming operation (S4) of causing the material 15 rapidly heated through the rapid heating operation to sequentially pass through the plurality of forming stations 31, 32, 33, and 34 and continuously performing a plurality of individual formings on the material 15.

In one form, in the rapid heating operation S3, the material 15 is rapidly heated from a point in time at which the pre-processing operation S2 is terminated to a point in time at which the forming operation S4 starts to be performed. This is because heating of the material 15 is desired to be performed at a high rate in order to effectively interwork with a transfer rate of the material 15 and a forming rate of the forming stations 31, 32, 33, and 34.

In another form, a heating rate of the material 15 is 30° C./s or higher. Here, 30° C./s refers to the lowest rate at which products may be mass-produced when manufacturing cost of products formed by the progressive forming method is considered.

As described above, according to an exemplary form of the present disclosure, since the rapid heating process is applied between individual processes of the progressive method, forming quality and machining accuracy regarding a low formability material such as ultra-high strength steel, or the like, may be increased, and in particular, since a low formability material is rapidly heated before individual forming desiring high formability, forming quality and machining accuracy may be significantly enhanced.

In this manner, by easily applying a low formability material, which is difficult to apply to an existing progressive method, to a short cycle time of the progressive method through rapid heating, productivity may be significantly enhanced.

Hereinabove, the present disclosure is not limited to forms described above, but may be variously modified and altered by those skilled in the art to which the present disclosure pertains without departing from the spirit and scope of the present disclosure.

What is claimed is:

1. A progressive die machine for continuously forming a material, while sequentially transferring the material, the progressive die machine comprising:

a lower die;

an upper die installed to vertically reciprocate with respect to the lower die;

a plurality of forming stations installed in the upper die and the lower die;

a heating station installed adjacent to at least one of the plurality of forming stations, and a pre-forming station installed adjacent to an entrance of the upper die and the lower die, wherein the heating station is disposed between the pre-forming station and the plurality of forming stations, wherein the heating station is mounted to at least one of the upper die or the lower die by a heating mold, and configured to heat sequentially transferred material cooperatively according to an operation of the upper die and the lower die, wherein the heating mold has an accommodation space opened toward the material, and a heat source of the heating station is disposed in the accommodation space, wherein the heat source is spaced apart from the sequentially transferred material, and wherein the heating station includes a reflector configured to reflect heat generated by the heat source toward the sequentially transferred material.

2. The progressive die machine according to claim 1, wherein the heat source is a laser source, and the reflector has a curved surface.

3. The progressive die machine according to claim 2, wherein an optical member configured to distribute heat from the laser source is disposed between the laser source and the sequentially transferred material.

4. The progressive die machine according to claim 1, wherein the heat source is an inductive heating coil, and the reflector has a curved surface.

5. The progressive die machine according to claim 4, wherein a thermally conductive heating body is disposed between the inductive heating coil and the sequentially transferred material, and the thermally conductive heating body is installed to be in contact with the sequentially transferred material or to be spaced apart from the sequentially transferred material.

6. The progressive die machine according to claim 1, wherein the reflector has a parabolic curved surface.

7. The progressive die machine according to claim 1, wherein the reflector has an open oval curved surface.

8. The progressive die machine according to claim 1, wherein the heating station includes a first heater installed on a upper die side and a second heater installed on a lower die side.

9. A progressive die machine for continuously forming a material, while sequentially transferring the material, the progressive die machine comprising:

a first die;

a second die configured to reciprocate with respect to the first die, the first and second dies being arranged opposite each other and aligned;

a plurality of forming stations installed in the second die and the first die;

a heating station installed adjacent to at least one of the plurality of forming stations, and a pre-forming station installed adjacent to an entrance of the upper die and the lower die, wherein the heating station is disposed between the pre-forming station and the plurality of forming stations, wherein the heating station is mounted to at least one of the upper die or the lower die via a heating mold, and configured to heat sequentially transferred material cooperatively according to an operation of the upper die and the lower die, wherein the heating mold has an accommodation space opened toward the material, and a heat source of the heating station is disposed in the accommodation space, wherein the heat source is spaced apart from the sequentially transferred material, and wherein the heating station includes a reflector configured to reflect heat generated by the heat source toward the sequentially transferred material.

* * * * *